US005237155A

United States Patent [19]

Hill

[11] Patent Number: 5,237,155

[45] Date of Patent: Aug. 17, 1993

[54] ELECTRIC HEATING DEVICE ENCASED IN POLYMER CEMENT AND METHOD OF MAKING SAME

[75] Inventor: Robert G. Hill, Downpatrick, Northern Ireland

[73] Assignee: Acrilyte Technology Limited, County Down, Northern Ireland

[21] Appl. No.: 189,839

[22] Filed: May 3, 1988

[30] Foreign Application Priority Data

May 5, 1987 [GB] United Kingdom ..... 8710634

[51] Int. Cl.[5] ..... H05B 3/44; H05B 3/00

[52] U.S. Cl. ..... 219/544; 219/213

[58] Field of Search ..... 219/544, 213, 530, 540, 219/541, 457; 338/269, 270, 275; 106/40 R; 52/309.3, 741, 220

[56] References Cited

U.S. PATENT DOCUMENTS

| | | | |
|---|---|---|---|
| 3,578,629 | 5/1971 | McManimie | 260/41 |
| 3,686,472 | 8/1972 | Harris | 219/213 |
| 3,781,527 | 12/1973 | Tymzcak | 219/540 |
| 4,085,180 | 4/1978 | Stoffey | 264/128 |
| 4,141,187 | 2/1979 | Graves | 52/173 R |
| 4,187,210 | 2/1980 | Howard, Jr. | 260/42.14 |
| 4,335,228 | 6/1982 | Beitchman et al. | 525/528 |
| 4,371,639 | 2/1983 | Muszynski | 523/512 |
| 4,564,745 | 1/1986 | Deschenes | 219/213 |
| 4,707,504 | 11/1987 | Walkowiak | 523/109 |

FOREIGN PATENT DOCUMENTS

| | | |
|---|---|---|
| 2151626 | 10/1975 | Fed. Rep. of Germany . |
| 2535622 | 2/1977 | Fed. Rep. of Germany . |
| 534997 | 4/1973 | Switzerland . |
| 752005 | 7/1956 | United Kingdom . |
| 1396590 | 6/1975 | United Kingdom . |
| 1553497 | 9/1979 | United Kingdom . |

*Primary Examiner*—Bruce A. Reynolds
*Assistant Examiner*—Michael D. Switzer
*Attorney, Agent, or Firm*—Finnegan, Henderson, Farabow, Garrett & Dunner

[57] ABSTRACT

An electric heating device is provided by the use of an electrical conductor or resistance element which is formed in the shape of a cable harness and encased in a polymer cement block. The conductor can be metal, alloy, or carbon fibre and the cement block, which has good electrical insulating and good heat conducting properties, is composed of approximately 75%-95% by weight of inorganic or mineral filler and 5%-25% of a polymer or plastics material. The electrical element is wound in harness form so that the required wattage is dissipated within the block without the requirement of any type of thermostatic control. Further by the selection of pigments and various combinations of mineral or inorganic material, heating devices can be produced having any desired size, shape or decorative texture.

32 Claims, 2 Drawing Sheets

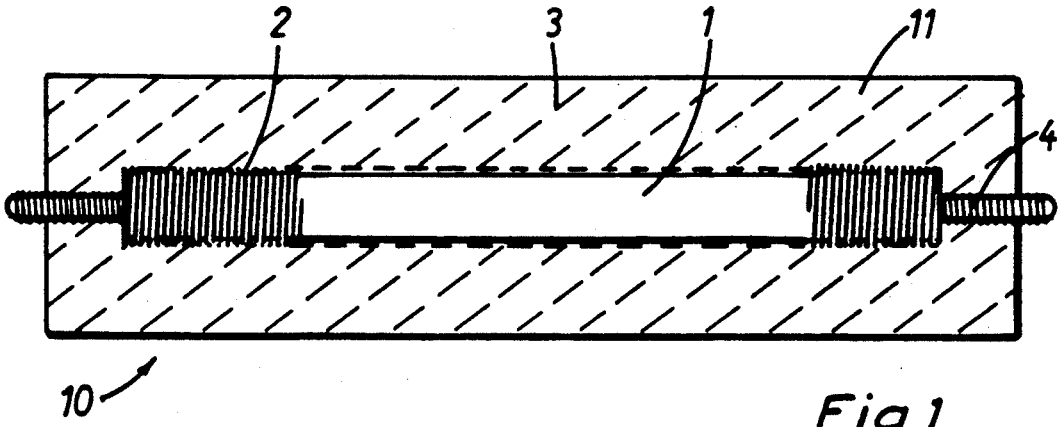
Fig 1
Fig 2
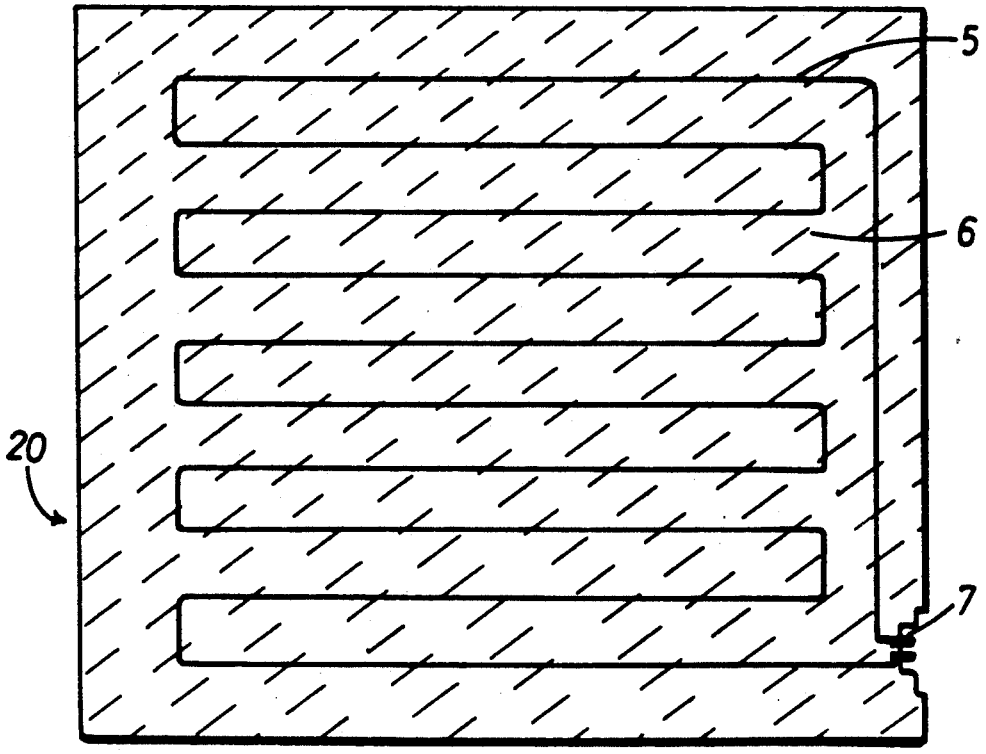

ELECTRIC HEATING DEVICE ENCASED IN POLYMER CEMENT AND METHOD OF MAKING SAME

This invention relates to an electric heating device.

There are as many shapes of electric heaters as there are uses for them but invariably they consist of devices which either operate at a red heat or run at a lower surface temperature because of an associated thermostatic control.

Because of the cooling effect of air currents, therethrough, fan or convector heaters can have resistance elements which operate at between 400° C. and 500° C. However ,in the event of a fan failure or a restriction to the free flow of air, a thermal cut-out device must be incorporated therein.

An electric radiator can take the form of an oil-filled device which must be thermostatically controlled so that the temperature at the surface of heater does not run at a value which could cause the carbonisation of the heat transfer oil in the radiator chamber.

Dry electric radiators need not be thermostatically controlled but they tend to be lightweight tubular steel devices which enclose a very hot element separated from the surface of the tubular case by an air space of about 2 centimeters in radius.

Finally, in the case of an electric blanket there is a device which is thermostatically or proportionator controlled so that the very fine copper wire, which is the resistance element, cannot operate with a surface temperature which is in excess of the decomposition temperature of the blanket fabric.

In all these device some form of protection is necessary in order to control temperature and in every case the resistance elements used either run at high temperatures, or would run at high temperatures if the thermostatic control was lost through faults.

It is an object of the present invention to overcome these problems.

According to the present inention there is provided an electric heating device which comprises an electrical conductor or resistance element encased in a polymer cement block comprising between 75% and 95% by weight of an inorganic or mineral material having a particle size of between 0.005 mm and 20 mm and between 5% and 25of a cured polymer or plastics material; and means for making an electrical connection externally of the block to the conductor or element.

The invention also provides a method of making an electric heating device which method comprises (a) providing a mould having a shape or configuration suitable for the intended use of the device;

(b) supporting an electrical conductor or resistance element substantially centrally within the mould;

(c) providing an electrical connection means between the element and externally of the mould;

(d) adding to the mould a cement mixture so as to substantially fill the mould which cement mixture comprises (i) between 75% and 95% by weight of an inorganic or mineral material having a particle size of between 0.005 mm and 20 mm; and (ii) between 5% and 25% by weight of a monomer which is capable of polymerisation by the use of a suitable catalyst;

(e) allowing the monomer to polymerise and the resulting mixture to cure; and (f) removing the device from the mould.

Furthermore, the inention provides a method of making an electric heating device which method comprises (a) providing a mould having a shape or configuration suitable for the intended use of the device;

(b) supporting an electrical conductor or resistance element substantially centrally within the mould;

(c) providing an electrical connection between the element and externally of the mould;

(d) adding to the mould a cement mixture so as to substantially fill the mould which cement mixture comprises (i) between 75% and 95% by weight of an inorganic or mineral material having a particle size of between 0.005 mm and 20 mm; and (ii) between 5% and 25% by weight of a powdered plastics material having a particle size which enables the plastics material to coat the inorganic or mineral material;

(e) applying heat and/or pressure so as to cure the resulting mixture;

(f) removing the device from the mould.

The particle size of the inorganic or mineral material is preferably in the range 0.05 mm to 3 mm. Most preferably, up to 25% by weight of the inorganic or mineral material has a particle size of between 0.05 mm and 0.3 mm. The inorganic or mineral material may be any finely divided matter ranging from sand through powdered glass to pulverised rock of any type. Preferably, the inorganic or mineral matter may be selected from the group consisting of sodium bicarbonate, trisodium polyphosphate, calcium phosphate, barium sulphate, barytes, bismuth oxychloride, barium thiosulphate, quartz, limestone, slate, marble, sandstone or glass.

The cured polymer may be derived from a liquid monomer which is chemically compatible with the mineral or inorganic material which monomer may be hardened, set or polymerised by the use of a suitable catalyst. The monomer may be selected from the group consisting of acrylic, acrylate, methoacrylate, methyacrylate, polyester or epoxy systems. The catalyst used depends on the type of system to be polymerised or cured. Such catalysts include benzoyl peroxide, methylethylketone peroxide, an amine, ultraviolet radiation or gamma radiation.

The plastics material preferably comprises a powdered polymer material having a particle size which enables the polymer material to coat the inorganic or mineral matter and, following the application of heat and pressure, provides, together with the inorganic material or mineral matter, a consolidated polymer cement block.

The polymer cement block comprises between 5% and 25% by weight of the plastics material, preferably 10% to 15% by weight. The plastics material can be high density polyethylene or polypropylene or nylon which is commercially available in particle sizes between 150 and 200 B.S. mesh sizes. The plastics material can be natural (colourless) or one or more of a large range of primary and pastel colours.

Simple mixing of the inorganic or mineral material with the plastics material by the use of a shovel or ribbon mixer is sufficient for good coating of the inorganic or mineral material by the plastics material. The inorganic or mineral material selected must be stable at the temperature of heat treatment and pressure employed during curing. Vibration and vacuumising of the mix in the mould is not normally required before application of the heat.

Pressure of about 15.4 mN/m$^2$ (1 ton or less per square inch) is all that is required, under heat treatment, in order to cause the plastics material to flow and give a finished laitence on the finished device. The temperature required is controlled to about 5° C. above the softening point of the plastics material.

An example of a ceramic/chalk marble mix is as follows:

| | | |
|---|---|---|
| Calcium carbonate | 0.005–0.3 mm | 17 p.b.w.* |
| Ceramic particle range | 0.25–0.5 mm | 24 p.b.w. |
| Ceramic particle range | 0.3–0.8 mm | 27 p.b.w. |
| Ceramic particle range | 1.0–1.8 mm | 32 p.b.w. |
| Benzoyl Peroxide | 2% | |
| Methacrylic resin and pigments (inorganic) | 10.5% | |

(*parts by weight)

The mixing time was about 180s and the vibration compaction time was about 240s at 150 Hz. The polymerisation time was about 2 hours.

The electrical conductor or resistance element may comprise an alloy of chrome and nickel or iron and aluminum or a fibrous filamentous material such as carbon fibre.

In the method of making the heating device, in order to remove air from the curable mixture, in the case of the monomer, or the resulting mixture in the case of the plastics material, the mould may be vibrated or vacummised. To assist, an additive selected from the group consisting of N,N-dimethyl-p-toludine, N,N-dimethylaniline, diphenylmethane-4,4-diisocyanate or triethylene glycol dimethacrylate may be used.

Embodiments of the invention will now be described by way of example with reference to the accompanying drawing in which:

FIG. 1 is a cross-sectional view of a first embodiment of a heating device according to the invention;

FIG. 2 is a cross-sectional view of a second embodiment of a heating device according to the invention.

Figure 3:
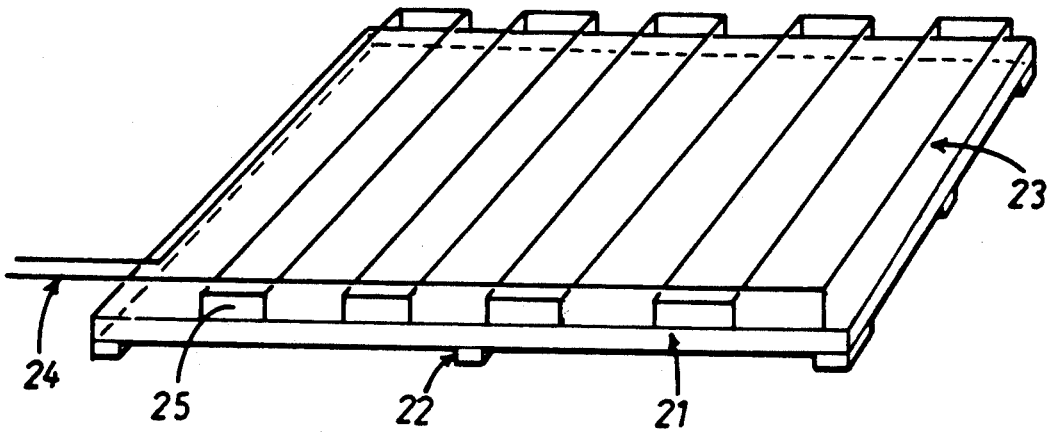
FIG. 3 is a perspective view of a harness frame and resistance element for use in the manufacture of a heating device according to the invention.

Referring to the drawings and in particular to FIG. 1 thereof, there is shown a heating device 10 according to the invention which comprises a nickle/chrome resistance wire 2 which has been wound on a ceramic former 1 in the form of a helix with wire ends terminating in bus bars 4. Allowing for electrical connection to the bus bars 4, the ceramic former 1 is encased in a polymer cement block 11.

The heating device 10 was manufactured by first placing the ceramic former 1 substantially centrally of a suitably shaped mould while allowing for electrical connection to the bus bars 4. Into the mould was placed a cement mixture comprising approximately 87% by weight of sandstone and approximately 13% by weight methylmethacrylate monomer. Just prior to the placing of the mixture into the mould, a sufficient quantity of benzoyl peroxide was added to the cement mixture for the polymerisation of the monomer. The quantity of catalyst required will be variable having regard to the ambient temperature and speed of curing required. Following the addition of the cement mixture with catalyst to the mould, the mould was subject to vibration, so as to ensure even distribution of the mixture in the mould and to assist in the removal of air therefrom. If desired, the mould could be subject to vacuum to assist in the removal of trapped air.

Following polymerisation and curing, the resulting device 10 was removed from the mould.

The cross-sectional area of the block is about 7 cm$^2$. The device was operated at 50 volts AC and was run for many days, at equilibrium, with a continuous surface temperature of 90° C. No thermostats were included with the device and when the block 10 was sawn into two pieces it was observed that the polymer cement block was not damaged, degraded or discoloured at the interface between the nickle/chrome wire 2 and the cement block.

Referring now to FIG. 2 of the drawings, there is shown a device 20 according to the invention which comprises a resistance wire or element 5 of a bar fire (not shown) unwound and evenly distributed throughout a large thin block 6 of a polymer cement so that the wire ends can be neatly terminated in a flush socket 7 which allows for safe connection to the public power supply. The thickness of the block or radiator is about 15 mm. The resistance wire 5 of iron/aluminum alloy is adapted to operate at the voltage of the public supply (110–120 V or 220–240 V) and yet operate in equilibrium, without thermostatic control, at a surface temperature of about 65° C. The composition of the cement block is similar to that of the cement block of FIG. 1 of the drawings. The device 20 was constructed to be free-standing but it could equally perform as a wall mounted room heater or radiator.

In the manufacturing of heating devices according to the invention, it is important, though not essential, that the electrical conductor or resistance element be held tautly when being encased in the block. Furthermore, regardless of the shape of the heating device but more particularly when the heating device has a shape other than a simple geometric shape, it is usually necessary to support the metal conductor or resistance wire tautly in, and to mirror the shape of, the heating block. This may best be achieved by providing a cable harness.

Referring now to FIG. 3 of the drawings, the cable harness comprises a suitably shaped frame 21 made from polypropylene having an electrical conductor or resistance element 23 loomed across studs 25 located substantially equidistant along the frame 21. Wire flying leads 24 are connected to a suitable socket (not shown). The frame 21 also has stand-off feet 22 mounted thereon so that when the frame 21 is placed in a suitably shaped mould, the feet 22 will stand on the base of the mould and the frame 21 with the metal conductor or resistance element 23 thereon will be located substantially centrally of the depth of the mould. The use of feet 22 may be dispensed with and the frame 21 suspended from above by means of suitable polypropylene threads (not shown) so as to be located centrally of the depth of the mould. Following curing, the threads may be cut. The exposed threads on the surface of the device will not affect the overall aesthetic appeal of the heating device due to the very small diameter of the threads used. The socket is integrally moulded with the harness.

Because the metal conductor or resistance element will be selected so as to not operate at a temperature above 95° C., the use of a polypropylene frame and supports is acceptable.

Each heating device can be made to order by carefully selecting resistance wire of proper cross-section from a variable range selection depending on alloy type and electrical resistance per meter length. For most applications, it is convenient to have a wire packing density to produce devices which can dissipate about 1 kw per square meter.

Depending on the thermal conductivity of the mixture, surface temperatures will be directly proportional to the wattage. An example of surface temperature for a heating device comprising, 91% of a mixture of silica and calcium carbonate, was 75° C. for a device which dissipated 700 watts/$m^2$.

The types and shapes of devices which can be constructed using the teaching of the invention are numerous. It is believed that the life of the devices according to the invention will be relatively long compared with conventional devices since the resistance elements are not in contact with the air, are vibration free and only run at surface temperatures well below 100° C. Indeed, in the design of a heating device according to the invention, it is necessary not only to consider the relevant safety temperatures of the surface of the heating device when in operation bearing in mind that a thermal cut-off device is unnecessary but also to be acquainted with the thermal decomposition temperature of the cured polymer or plastics material used in the construction of the heating device.

The decorative properties of the polymer cement block used in the construction of heating devices according to the invention can be exploited. The heating devices can be moulded as decorative well plaques or panels. Wall mounted radiators can be thick or thin and can have gel-coats which are metallised with flitters (or foil flakes of aluminum, copper, bronze or tin) or pigmented in uniform swirled marble effects. The need for heated counters in kitchens or restaurants can safely be met with a heating device according to the invention and such surfaces can be both hygienic and decorative as well as acid and detergent resistant.

Decorative finishing textures like pewter, pearl, mother of pearl, onyx or marble can be simulated by the use of mineral and inorganic fillers like powdered tin, barium thiosulphate, bismuth oxychloride, sodium bicarbonate or chalk/lamp black mixtures may be employed.

It has been found that the heating devices according to the invention can be heated to 90° C. in a matter of three minutes and that a heating device weighing about 1.8 kg takes about twenty four minutes to return to ambient temperature. It is suggested that such a heating device, if placed in a fabric jacket, would constitute a dry "hot water bottle" which would be extremely safe for use with children and old people. Such a simple application could eliminate the high incidents of scalds to nurses who daily fill hot water bottles for patients in institutions.

The thermal conductivity of the heating device according to the invention is good and the reason can be gauged from the fact that the device comprises about 90% inorganic or mineral matter. Electron micrographs reveal that the particles of matter are only separated from each other by a thin film of polymer or plastics material. The thermal conductivity of the inorganic or mineral material is about twelve times greater than that of the polymer or plastics material.

As a consequence it follows that the overall heat transfer property of the heating device is closer to the properties of the inorganic or mineral material rather than that of the cured polymer or plastics material.

By judicious selection and mixing of fine inorganic and mineral material whose thermal conductivities fall within the range 41.86 to 125.6 $Wm^{-1}K^{-1}$, it is possible to produce heating devices which have the unusual property of combining useful thermal conductivity with excellent electrical insulation.

I claim:

1. An electric heating device which comprises an electrical conductor or resistance element encased in a polymer cement block comprising between 75% and 95% by weight of an inorganic or mineral material having a particle size of between 0.005 mm and 20 mm and between 5% and 25% of a cured polymer or plastics material; and means for making an electrical connection externally of the block to the conductor or element.

2. A device as claimed in claim 1 wherein the particle size of the inorganic or mineral material is in the range 0.05 mm and 3 mm.

3. A device as claimed in claim 1 wherein up to 25% by weight of the inorganic or mineral material has a particle size of between 0.05 mm and 0.3 mm.

4. A device as claimed in claim 1 wherein the inorganic or mineral material is sodium bicarbonate, trisodium polyphospate, calcium phosphate, berium sulphate, barytes, bismuth oxychloride, berium thiosulphate, quartz, limestone, slate, marble, sandstone or glass.

5. A device is claimed in claim 1 wherein the cured polymer is derived from a liquid monomer which is chemically compatible with the mineral or inorganic material and which monomer can be hardened, set or polymerised by the use of a catalyst.

6. A device as claimed in claim 5 wherein the monomer is an acrylic, acrylate, methacrylic, methacrylate, polyester or epoxy system.

7. A device as claimed in claim 5 wherein the catalyst is benzoyl peroxide, methylethylketone peroxide, an amine, ultra violet radiation or gamma radiation.

8. A device as claimed in claim 1 wherein the plastics material comprises a powdered polymer material having a particle size which enables the polymer material to coat the inorganic or mineral material and, following the application of heat and pressure, provides, together with the inorganic or mineral material, a consolidated polymer cement block.

9. A heating device as claimed in claim 8 wherein the polymer material comprises polyethylene or polypropylene.

10. A heating device as claimed in claim 1 wherein the electrical conductor or resistance element comprises an alloy of chrome and nickel.

11. A heating device as claimed in claim 1 wherein the electrical conductor or resistance element comprises an alloy of iron and aluminum.

12. A heating device as claimed in claim 1 wherein the electrical conductor or resistance element comprises a fibrous filamentous material.

13. A heating device as claimed in claim 12 wherein the fibrous filamentous material is carbon fiber.

14. A method of making an electric heating device which method comprises (a) providing a mold having a shape or configuration suitable for the intended use of the device;

(b) supporting an electrical conductor or resistance element substantially centrally in the mold;

(c) providing an electrical connection means between the element and externally of the mold;

(d) adding to the mold a cement mixture so as to substantially fill the mold which cement mixture comprises
  (i) between 75% and 95by weight of an inorganic or mineral material having a particle size of between 0.005 mm and 20 mm; and
  (ii) between 5% and 25% by weight of a monomer which is capable of polymerisation by the use of a suitable catalyst;
(e) allowing the monomer to polymerise and the resulting mixture to cure; and
(f) removing the device from the mold.

15. A method as claimed in claim 14 wherein the particle size of the inorganic or mineral material is in the range 0.05 mm and 3 mm.

16. A method as claimed in claim 14 wherein up to 25% by weight of the inorganic or mineral material has a particle size of between 0.05 mm and 0.3 mm.

17. A method as claimed in claim 14 wherein the monomer is an acrylic, acrylate, methacrylic, methacrylate, polyester or epoxy system.

18. A method as claimed in claim 14 wherein the catalyst is benzoyl peroxide, methylethylketone peroxide, an amine, ultraviolet radiation or gamma radiation.

19. A method as claimed in claim 14 wherein the inorganic or mineral material is sodium bicarbonate, trisodium polyphosphate, calcium phosphate, barium sulphate, barytes, bismuth oxychloride, barium thiosulphate, quartz, limestone, slate, marble, sandstone or glass.

20. A method as claimed in claim 14 which further comprises the step of vibrating and/or vacuumising the resulting mixture so as to remove trapped air therefrom.

21. A method as claimed in claim 14 which further comprises adding to the cement mixture a chemical additive so as to assist in the removal of air therefrom.

22. A method as claimed in claim 21 wherein the chemical additive comprises N,N-dimethylaniline, diphenylmethane-4,4-diisocyanate or triethylene glycol dimethacrylate.

23. A method of making an electric heating device which method comprises
(a) providing a mold having a shape or configuration suitable for the intended use of the device;
(b) supporting an electrical conductor or resistance element substantially centrally in the mold;
(c) providing an electrical connection means between the element and externally of the mold;
(d) adding to the mold a cement mixture so as to substantially fill the mold which cement mixture comprises
  (i) between 75% and 95% by weight of an inorganic or mineral material having a particle size of between 0.005 mm and 20 mm; and
  (ii) between 5% and 25% by weight of a powdered plastics material having a particle size which enables the plastics material to coat the inorganic or mineral material;
(e) applying heat and/or pressure so as to cure the resulting mixture;
(f) removing the device from the mold.

24. A method as claimed in claim 23 wherein the particle size of the inorganic or mineral material is in the range 0.05 mm and 3 mm.

25. A method as claimed in claim 23 wherein up to 25% by weight of the inorganic or mineral material has a particle size of between 0.05 mm and 0.3 mm.

26. A method as claimed in claim 23 wherein the plastics material is polypropylene or polyethylene.

27. A method as claimed in claim 23 wherein the inorganic or mineral material is sodium bicarbonate, trisodium polyphosphate, calcium phosphate, barium sulphate, barytes, bismuth oxychloride, barium thiosulphate, quartz, limestone, slate, marble, sandstone or glass.

28. A method as claimed in claim 23 which further comprises the step of vibrating and/or vacuumising the resulting mixture so as to remove trapped air therefrom.

29. A method as claimed in claim 23 which further comprises adding to the cement mixture a chemical additive so as to assist in the removal of air therefrom.

30. A method as claimed in claim 29 wherein the chemical additive comprises N,N-dimethylaniline, diphenylmethane-4,4-diisocyanate or triethylene glycol dimethacrylate.

31. A device as claimed in claim 1 which is substantially free of trapped air.

32. A device as claimed in claim 1 wherein the inorganic or mineral material has a thermal conductivity within the range of 41.86 to 125.6 $Wm^{-1}K^{-1}$.

* * * * *